US007923622B2

(12) United States Patent
Lazovic

(10) Patent No.: US 7,923,622 B2
(45) Date of Patent: Apr. 12, 2011

(54) ADAPTIVE TRIGGERS METHOD FOR MIDI SIGNAL PERIOD MEASURING

(75) Inventor: Darko Lazovic, Belgrade (YU)

(73) Assignee: Ediface Digital, LLC, Deer Park, IL (US)

( * ) Notice: Subject to any disclaimer, the term of this patent is extended or adjusted under 35 U.S.C. 154(b) by 787 days.

(21) Appl. No.: 11/873,970

(22) Filed: Oct. 17, 2007

(65) Prior Publication Data

US 2009/0100989 A1 Apr. 23, 2009

(30) Foreign Application Priority Data

Oct. 19, 2006 (RS) ..... P2006/0577

(51) Int. Cl.
*G10H 7/00* (2006.01)

(52) U.S. Cl. ..... 84/645

(58) Field of Classification Search ..... 84/645, 84/616, 654
See application file for complete search history.

(56) References Cited

U.S. PATENT DOCUMENTS

| | | | | |
|---|---|---|---|---|
| 3,571,522 | A | 3/1971 | Cox | |
| 4,217,808 | A | 8/1980 | Slepian et al. | |
| 4,523,506 | A | 6/1985 | Hollimon | |
| 4,627,323 | A | 12/1986 | Gold | |
| 4,688,464 | A | 8/1987 | Gibson et al. | |
| 4,702,141 | A * | 10/1987 | Bonanno | 84/626 |
| 4,829,872 | A | 5/1989 | Topic et al. | |
| 5,018,427 | A | 5/1991 | Uchiyama et al. | |
| 5,033,353 | A | 7/1991 | Fala et al. | |
| 5,048,391 | A | 9/1991 | Uchiyama et al. | |
| 5,083,491 | A | 1/1992 | Fields | |
| 5,262,714 | A | 11/1993 | Friedman | |
| 5,293,879 | A | 3/1994 | Vonk et al. | |
| 5,430,243 | A | 7/1995 | Shioda | |
| 5,504,270 | A | 4/1996 | Sethares | |
| 5,619,004 | A | 4/1997 | Dame | |

(Continued)

FOREIGN PATENT DOCUMENTS

| | | |
|---|---|---|
| JP | 2002215145 | 7/2002 |
| SU | 1167642 | 7/1985 |

OTHER PUBLICATIONS

O'Malley, Ronan; "Advanced MIDI Guitar Effects System"; Department of Electronic Engineering; pp. 4; National University of Ireland.

(Continued)

*Primary Examiner* — Jeffrey Donels

(57) ABSTRACT

An initial positive trigger value is above a minimum positive trigger value which is above an input signal DC component value. An initial negative trigger value is under a maximum negative trigger value which is under the input signal DC component value. Maximum and minimum signal values are measured and then they are used for the next positive and negative trigger value calculations. A positive signal half period is measured by measuring the time interval from the time point when a signal value becomes greater than the positive trigger value, to a time point where the input signal becomes less than the negative trigger value when the negative half period measuring starts. The negative half period measuring ends when the input signal value becomes greater than the positive trigger value. Positive and negative half period measurements are repeated several times and measured half periods are stored to memory. The difference of two different half period sums must be less than a given small value to accept one of two sums as N signal periods.

4 Claims, 9 Drawing Sheets

U.S. PATENT DOCUMENTS

| | | | |
|---|---|---|---|
| 5,780,759 | A | 7/1998 | Szalay |
| 5,808,225 | A | 9/1998 | Corwin et al. |
| 5,942,709 | A | 8/1999 | Szalay et al. |
| 6,166,566 | A | 12/2000 | Strong |
| 6,525,255 | B1 | 2/2003 | Funaki |
| 6,846,980 | B2 | 1/2005 | Okulov |
| 7,038,123 | B2 | 5/2006 | Ludwig |
| 7,102,072 | B2 | 9/2006 | Kitayama |
| 2003/0061931 | A1 | 4/2003 | Ishii et al. |
| 2006/0011052 | A1 | 1/2006 | Purchon et al. |
| 2007/0017345 | A1 | 1/2007 | Stoneback |
| 2007/0137466 | A1 | 6/2007 | Lindemann |

OTHER PUBLICATIONS

Karjalainen et al.; "Acoustic Sound from the Electric Guitar Using DSP Techniques"; Journal; 2000; pp. 773-776; IEEE.

Baalman, Marije A. J.; "The Strimidilator: a String Controlled MIDI-Instrument"; Proceedings of the 2003 Conference on New Intefaces for Musical Expression; pp. NIME 03-19 to NIME 03-23.

International Search Report and Written Opinion from corresponding PCT/US07/81662.

International Search Report from corresponding PCT/US08/52940.

* cited by examiner

ADAPTIVE TRIGGERS METHOD FOR MIDI SIGNAL PERIOD MEASURING

TECHNICAL FIELD

This invention generally pertains to musical instruments that generate sound from electronic media. More specifically, this invention pertains to devices that control the sound generation of electronic instruments from electronic media based on the input signal comprising basic harmonics. Sound generation on electronic instruments is usually achieved by keyboards, but also can be achieved with classical instruments (or any sound source) whose sound is analyzed, and then based on detected first harmonic, generates an appropriate electronic instrument sound. The second method requires fast and precise first harmonic period determination from the signals generated by a classical instrument, and then the measured period may be transformed to digital information acceptable by electronic instruments.

BACKGROUND ART

Some methods for solving the above mentioned problem are already patented by well known companies as Yamaha Corporation and Casio. Other inventors have their own methods for solving above mentioned problem.

U.S. Pat. No. 7,102,072 assigned to Yamaha Corporation describes an apparatus and program which forms an envelope function that follows maximum signal values. The method uses signal envelope points selected at characteristic signal time points to determine signal period.

U.S. Pat. No. 5,619,004 assigned to Virtual DSP Corporation is based on correlation functions that need powerful computers.

Many patents use zero crossing points for signal period calculation. The principle of using a zero crossing point is described in U.S. Pat. No. 4,523,506. For complex signals this method is not appropriate.

Another method for signal period determination is based on peak detector (maximum signal detector) and measuring the time interval between two consecutive detected maximums. This method is good for simple signals; complex signals can have more than one maximum in one signal period.

To overcome problems seen with peak detectors and zero crossing detectors, methods using several reference levels were developed. One such method is described in U.S. Pat. No. 4,217,808, where an amplifier with automatic gain control amplifies an input signal. The output of the automatic gain control amplifier is a signal with equal maximum and minimum signal levels. Positive and negative triggers are then set as scaled down maximums or minimums of the amplified signal. The signal period is then measured as the time between first signal and positive trigger crossing point and second signal and positive trigger crossing point when separated by a negative trigger and negative signal crossing point. The automatic gain amplifier is used and trigger values are constant.

The method described herein amplifies the input signal with constant amplification and value of triggers are changed as the input signal maximum and minimum changes. The method herein also defines fast input signal loss detection and criteria for multiple signal period detection. The method herein measures signal half period duration and based on two sums of half period determines multiple signal period. The method herein defines minimum and maximum trigger values and initial trigger values which helps when input signal amplitude varies in time.

In distinction, U.S. Pat. No. 4,627,323 describes a process where signal period measuring is based on two consecutive signal maximum. U.S. Pat. No. 4,688,464 describes a process where some trigger values are changed over time but they are used to detect positive and negative reference peak while signal period measuring is based on a crossing point between constant triggers and a rising signal edge that leads to a positive reference peak. In U.S. Pat. No. 4,688,464, one trigger is set at zero and second is set a little above zero, such that the two crossing points are separated with one negative reference peak. Two consecutive signal periods are compared, and if the difference is quite small they are accepted as periods.

DISCLOSURE OF INVENTION

The method of the present invention calculates maximum and minimum values of a input signal and then calculates positive and negative trigger values as a scaled-down maximum or a scaled-down minimum value of the input signal. The cross-point of the positive trigger level and the input signal curve is the point in time where positive signal half period duration measurement starts. Positive half period duration measurement ends at the next negative trigger level and input signal curve cross-point. During the positive half period duration measurement, the next positive trigger value is calculated. The measured positive half period is stored to a first free memory location. The cross-point of the negative trigger level and the signal curve is the point in time where the negative signal half period duration measurement starts. Negative half period duration measurement ends at the next cross-point of the positive trigger value and the input signal curve. During the negative half period measurement, the next negative trigger value is calculated. The measured negative half period is then stored to the next free memory location, after the positive signal half period. The positive half period measuring and then the negative half period measuring can be repeated several times.

The method of the present invention calculates the period by calculating two sums (S1 and S2) of the consecutive positive and negative half periods durations with an equal number of addends but with at least one different addend. As will be described below in greater detail, memory associated with a microcontroller will store the first measured positive half period duration in the first free memory location, the next negative half period duration in the next free memory location, the next positive half period duration in the next free memory location, the next negative half period duration in the next free memory location, and so on until signal loss is detected. Thus, as the positive and then negative half period durations appear in time with the input signal, they appear in memory in the same sequence. In other words, labeling the positive half period duration with P and the negative half period duration with N, the values are stored in memory in the order P1, N1, P2, N2, P3, N3, P4, N4, P5, and N5. P1 and N1 together form the first signal period duration. P2 and N2 together form the second signal period duration. P3 and N3 form third signal period duration. In accordance with the method and using one different addend when calculating the sum S1 and S2, the sum S1 may equal the sum of P1+N1+P2+N2. The sum S2 may be calculated as: (a) S2=N1+P2+N2+P3; (b) S2=P3+N3+P4+N4; or (c) S2=P2+N2+P3+N3. Although both sums S1 and S2 have 4 addends, sum S1 has at least one different addend. If the sum difference (S1−S2) is small enough, then any of two sums can be taken as a multiple signal period duration. The initial value of the positive trigger is above a minimum positive trigger value, which is above the input signal's DC component value. The initial negative trigger is under the maximum negative trigger value which is under the input signal DC component value. If during the half period duration measurement, the half period duration becomes greater than the maximum half period duration, then the measurement is stopped and signal loss is detected.

BEST MODE FOR CARRYING OUT OF THE INVENTION

Figure 1A:
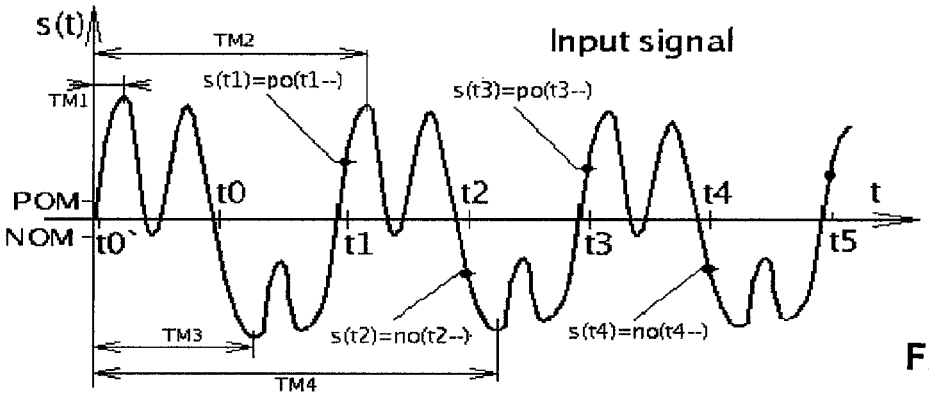
FIG. 1*a* shows a graph of input signal amplitude measured over time.
Figure 1B:
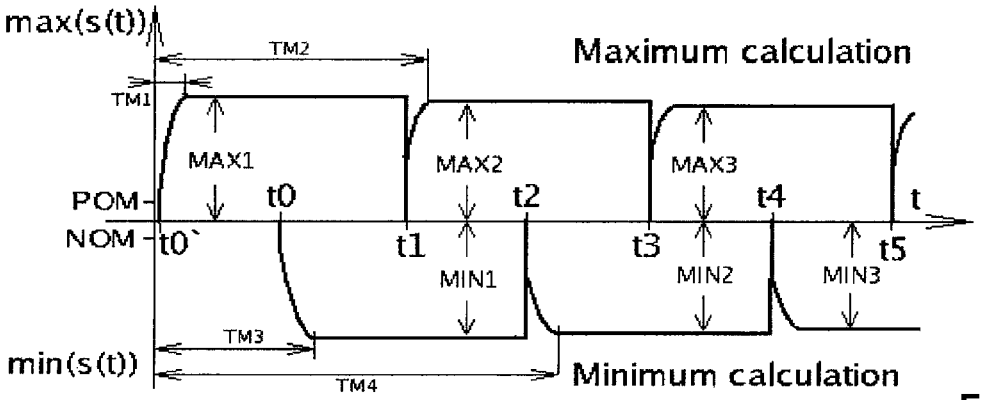
FIG. 1*b* shows a graph of the calculation of maximum input signal amplitude and minimum input signal amplitude over time.
Figure 1C:
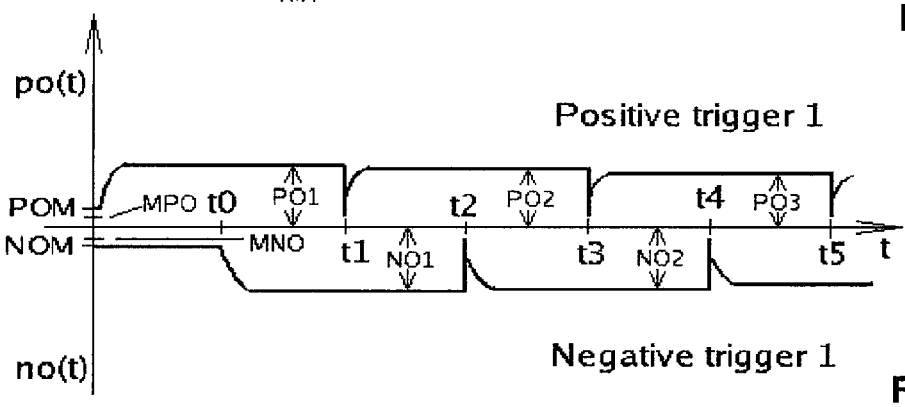
FIG. 1*c* shows a graph of the change in time of the positive and negative trigger value that is concurrently calculated with maximum input signal amplitude calculation.

The present invention comprises a method for measuring the first harmonic period from an audio signal waveform. FIG. 1*a* shows typical waveforms which will be used to describe the principles of the method. In FIG. 1*a*, the amplitude of the input signal is shown with strong high harmonics and is plotted on the coordinate s(t), and a DC component level is plotting on the "t" coordinate (the "t" coordinate overlaps the DC component). In this method, the input signal maximum measuring starts when the input signal level becomes higher than the positive trigger level and ends when the input signal level becomes lower than the negative trigger level. FIG. 1*b* shows the wave form associated with the calculation of the maximum signal input and the minimum signal input as the functions max(s(t)) and min(s(t)). FIG. 1*c* shows the initial positive trigger value on the ordinate po(t) as value POM above the DC signal component level. FIG. 1*c* shows the minimum positive trigger value MPO which is lower and under the initial positive trigger value POM, and above the signal's DC component value. The next positive trigger value is calculated as a scaled down difference between the input signal maximum value and a DC signal component value added to the DC signal component value. If the calculation provides a positive trigger value less then minimum positive trigger value MPO, then the positive trigger value is set to minimum positive trigger value MPO. The next positive value can be calculated as a scaled down difference between the input signal maximum value and minimum positive trigger value MPO, which is then added to the minimum positive trigger value MPO. The points on the ordinate t1, t3, t5 are time points when the input signal value s(t) is higher (or higher or equal) than the positive trigger value po(t). If the positive trigger value po(t) is calculated concurrently with the maximum signal level calculation one may obtain a graph of positive trigger values as shown in FIG. 1*c*. When lower calculation power is important, the positive trigger values calculation can be performed in time periods when the input signal value becomes lower than the negative trigger value. The obtained value becomes the next positive trigger value. The last positive trigger value calculation principle is shown on FIG. 1*d* with the label Positive trigger 2.

Figure 1D:
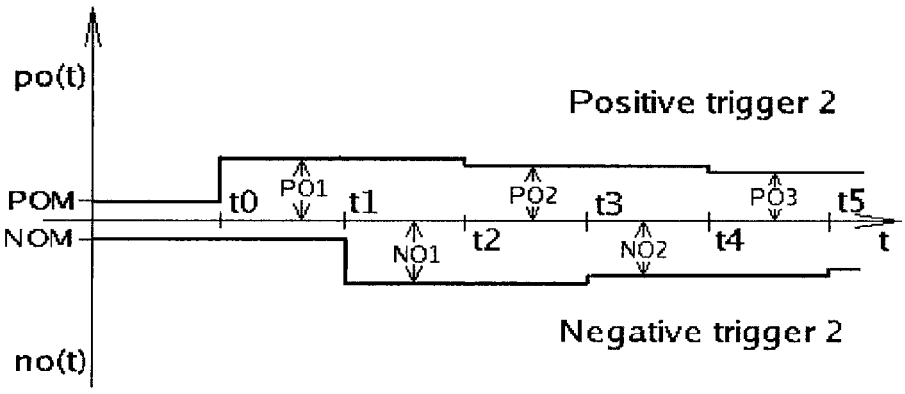
FIG. 1*d* show a graph of the change in time of the positive trigger value calculated at a point in time when the input signal value becomes less than the negative trigger value and the change in time of the negative trigger value calculated at a point in time when the input signal value becomes greater than the positive trigger value.

The initial negative trigger value is shown in FIGS. 1*a*-1*d* as NOM with a value less than the input signal DC component. The maximum negative trigger value MNO is less than the input signal DC component value and greater than the initial negative trigger value NOM. As will be discussed later, the next negative trigger value is calculated as a scaled down difference between the input signal DC component value and the input signal minimum value, which is then subtracted from the input signal DC component value. If the negative trigger value calculation gives a result that is greater than the maximum negative trigger value MNO, the negative trigger value is then set to the maximum negative trigger value MNO. The next negative trigger value may be calculated as a scaled down difference between the maximum negative trigger value MNO and the input signal minimum value, which is then subtracted from the maximum negative trigger value MNO. FIG. 1*c* shows a first case where the negative trigger value is calculated concurrently with the input signal maximum value calculation. FIG. 1*d* shows a second case where the negative trigger value is calculated when the input signal value is greater than the positive trigger value.

Further detail of one method is described below. The initial positive trigger value is set to a value POM and the initial negative trigger value is set to a value NOM. When the input signal value becomes greater than the positive trigger value (at time point t1), the positive half period interval measuring starts, the input signal value is acquired and the maximum signal value is changed if the newly acquired input signal value is greater than the current maximum signal value previously recorded. FIG. 1*b* shows the input signal maximum change over time with a curve that follows the input signal shape (one of curves starts in time point t1). When the input signal reaches its maximum value, the input signal maximum value becomes constant up to the next time point when the maximum half period measuring starts (time point t3 is the next point in time when the input signal maximum calculation starts). The input signal maximum calculation continues up to a point in time when the input signal value becomes less than the value of the negative trigger value (from after time point t2). After that time point, the calculated maximum has a constant value up to the next time point where the maximum calculation begins again (at time point t3). The next positive trigger value can be calculated concurrently with the input signal maximum calculation or at a time point when the input signal value becomes less than the negative trigger value. The positive half period duration comprises the time duration from time point t1 when the input signal value becomes greater than or equal to the positive trigger value (the positive trigger calculated at time point t0) up to time point t2 when the input signal becomes less than the negative trigger value (the negative trigger value calculated at time point t1). When the positive half period duration is measured, it is stored in next free memory location.

When the input signal value becomes less than the negative trigger value, the minimum signal calculation begins and measuring of the negative half period duration starts (time point t2). The minimum signal value is changed if the input signal value becomes less than the last remembered minimal signal value. This is shown in FIG. 1*b* with a curve that follows the input signal shape (curve starts from point t2). When the signal reaches its minimum value, the input signal minimum value becomes constant up to the next minimum calculation (up to time t4). Concurrently with the minimum signal calculation, the calculation of the next negative trigger value can be done, and in this case, the negative trigger value curve is proportional to the input signal minimum curve as shown in FIG. 1*c*. The negative trigger value can be calculated at the moment when the input signal value becomes greater than the positive trigger value. This case is also shown on FIG. 1*d*. The minimum calculation continues until the input signal value becomes greater than or equal to the positive trigger value (at time point t3). After that time point, the minimum holds the minimum calculated value. The negative half period measurement comprises the time interval from time point t2 when signal value becomes less than the negative trigger value (the negative trigger value calculated at time point t1) up to time point t3 when the signal value becomes greater than the positive trigger value (the positive trigger value calculated at time period t2). The measured negative signal half period duration is stored in the next free memory location.

After measuring the negative half period, the positive half period measuring, the maximum signal value calculation and the next positive trigger value calculation starts again as described above. The end of the positive half period duration measuring is the same time point as the start of the negative half period duration measuring. The end of the negative half period duration measuring is the same time point as the start of positive half period duration measuring. The measuring of the positive half period duration and then the negative half period duration is repeated several times one after another, and the measured positive and negative half period duration values are recorded in consecutive free memory locations. The measuring of the positive or negative half period durations is stopped when the measured maximum and minimum values of the input signal are between maximum negative and minimum positive trigger values. In such a case, it is not possible to measure half period duration as there are no cross-points of the input signal curves with the curves of the negative and positive trigger values. The positive and negative half period measuring can also be stopped, if the value of the positive or negative measured half period duration becomes greater than the maximum half period duration. This may also mean that signal has disappeared, or that the signal amplitude is so small as to be non-existent.

After consecutive positive and negative half period durations are measured and recorded in memory, signal period calculation starts. A first sum is formed from consecutive positive and negative half period duration values recorded in memory in consecutive memory locations, and a second sum is formed from consecutive positive and negative half period duration values recorded in memory in consecutive memory locations. Both sums comprise equal number of positive and negative half periods. Each sum has an equal number of positive and negative half period duration values. However, the addend of the first sum may be the second or the third measured half period duration stored in memory. As described above, positive half period duration values P(n) and negative half period duration values N(n) are stored in memory in the order P1, N1, P2, N2, P3, N3, P4, N4, P5, and N5. P1 and N1 together form the first signal period duration. P2 and N2 together form the second signal period duration. P3 and N3 form third signal period duration. In accordance with the method and using one different addend when calculating the sum S1 and S2, the sum S1 may equal the sum of P1+N1+P2+N2. The sum S2 may be calculated as: (a) S2=N1+P2+N2+P3; (b) S2=P3+N3+P4+N4; or (c) S2=P2+N2+P3+N3. Although both sums S1 and S2 have 4 addends, sum S2 has at least one different addend. Thus, the first sum S1 consists of 2N consecutive positive and negative half periods stored in consecutive memory locations. The first half period duration value of the second sum S2 (previous example (a)) is the half period duration value stored in memory as the N1 half period duration value, which occurs after the first half period duration value of the first sum, i.e., P1. The first half period duration value of the second sum S2 can be stored in memory after last half period duration value of the first sum S1 but the first half period duration value of the second sum S2 can be also one of the first sum S1 half period duration values. As will be described, memory associated with the microcontroller contains values associated with the positive half period duration value, then the negative half period duration value, then the positive half period duration value, then the negative half period duration value, and so on. In other words, consecutive half period duration values are a positive half period duration value followed by a negative half period duration value, for instance, two positive half periods are separated by at least one negative half period. Thus, the memory contains in consecutive memory locations, consecutive half periods, e.g. a positive half period after a negative half period or a negative half period after a positive half period. If the difference between the two sum (i.e., S1−S2) is less than the given value D, then one of sums can be considered as N signal periods. In the example, the value D is 1/64 of the either calculated sum S1 or S2 (so D=1/64*S1 or D=1/64*S2). The value D can be adjusted so that detection criteria can be adjusted to various signal types. The sum difference (i.e., S1−S2) can be less than the value D or greater than the value D, but if, during the half period measuring, none of the stop criteria described above becomes applicable, the method considers that the input signal still exists, and the positive trigger value is set to the minimum positive trigger value MPO, the negative trigger value is set to the maximum negative trigger value MNO, the maximum and minimum signal values are set to the DC signal level component, and the positive half period measuring starts again as described above.

Figure 2:
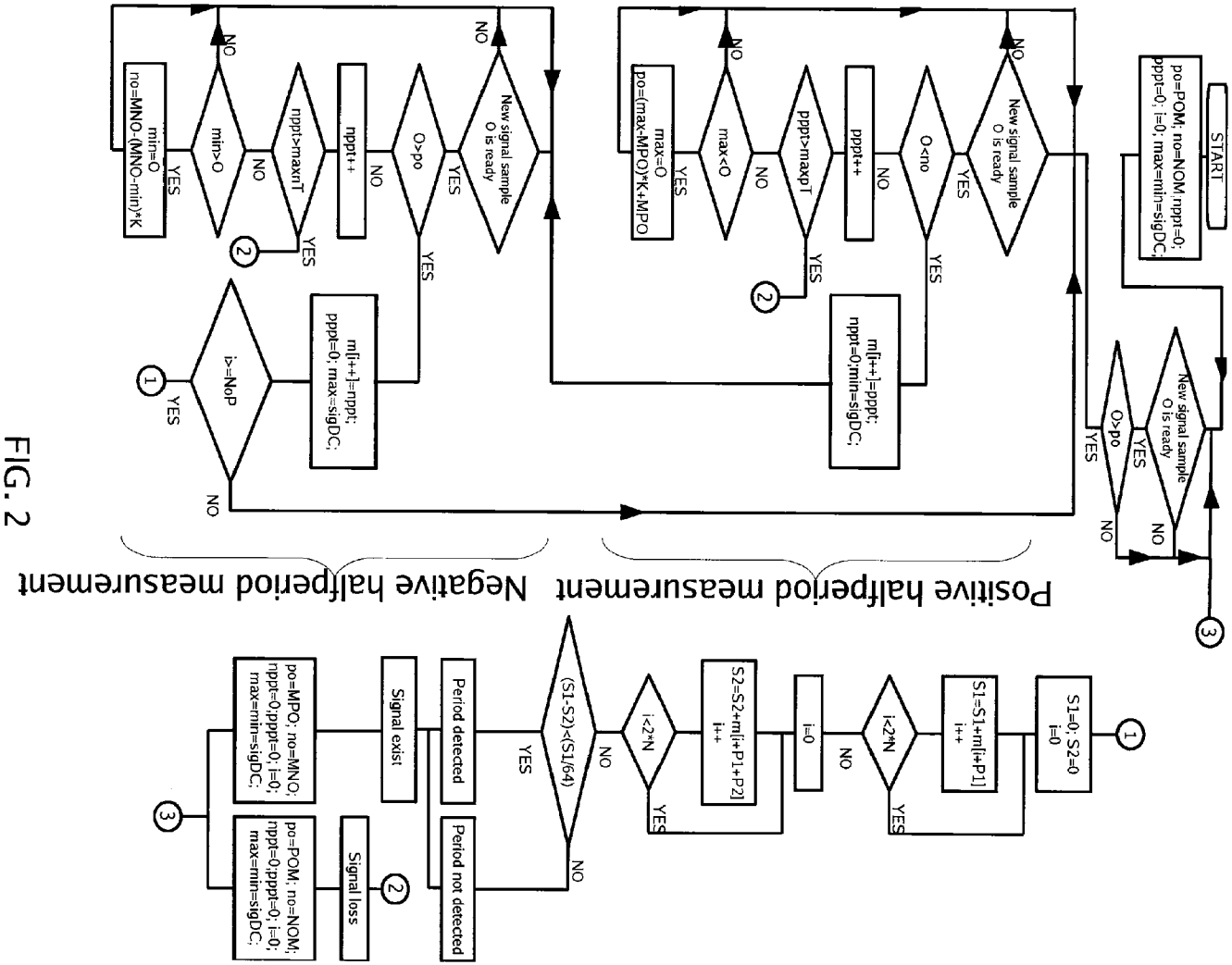
FIG. 2 shows a flow chart of the method described in this document where positive and negative trigger values are concurrently calculated with maximum and minimum input signal amplitude calculation.

FIG. 2 shows one algorithm that calculates trigger values concurrently with the maximum calculation. The algorithm begins with setting the initial values of the following variables: variables "max" and "min", (max is maximum signal value and min is minimum signal value) are set to the DC signal component value (max=min=sigDC); variable "po" is the positive trigger value with an initial value of POM; variable "no" is the negative trigger with initial value of NOM; both half period duration variables "pppt" and "nppt" are initially set to a 0 value. Half period duration is measured with sample numbers. Computation using this algorithm needs a computer with enough computational power so that the calculations between the two sample times can be done. After the initial variables are setup, the algorithm waits until the input signal becomes greater than the positive trigger values of variable "po."

The first part of the algorithm measures the positive half period duration and waits for the input signal value to be less than the negative trigger value, when the negative half period duration measuring can start. When the new sample is ready, the sample is entered in register O, the algorithm checks if the sample value is less than the negative trigger value stored in variable "no." If the sample value is less than the negative trigger variable value "no," then the positive half period measuring is finished, the measured positive half period duration variable "pppt" is stored to the first free location in memory "m," and the measuring of negative half period duration starts. If the sample value is greater than the negative trigger value "no," the variable "pppt" is incremented. If the measured half period duration is not greater than the maximum positive half period duration constant "maxpT," the algorithm continues with the input signal maximum calculation. If last remembered value of variable "max" is less than the current sample value, then the variable "max" is set to the current sample value O, and the new positive trigger value is calculated. If the sample value is less than the last remembered value of the variable "max", the algorithm waits for the next ready sample O.

During transition from the positive half period duration measuring to negative half period duration measuring, the variable "nppt" is set to value zero. As in the positive half period duration measuring, in the negative half period duration measuring, the algorithm waits for a new input signal sample in variable "O." When the sample variable "O" is ready, the algorithm checks if the sample value is greater than the positive trigger value calculated during the previous positive half period duration measuring. If the sample value is greater than the positive trigger value, then the negative half period duration measuring ends, the measured negative half period duration value is stored to first free location in array "m," and the measured value of the positive half period duration variable "pppt" is set to zero to be prepared for next positive half period duration measuring. If the new sample value is not greater than the positive trigger value, the negative half period measuring continues, the variable "nppt" is incremented (the variable "nppt" presents negative half period duration value). If the new value of the variable "nppt" is not greater than the value of the constant "maxnT", the algorithm continues with checking if the last remembered minimum value of variable "min" is greater than the value of the new sample variable "O." If it is, the variable "min" is set to the value of the current sample variable "O." and the new value of the negative trigger variable "no" is calculated. If the last recorded minimum value of variable "min" is less than the value of the sample variable "O," then the algorithm waits for a new value of sample variable "O." The positive or negative half period duration measuring is stopped if the measured half period durations becomes greater than the value of the given maximum half period duration constants "maxpT" and "maxnT."

After measuring a number of consecutive positive and negative half period durations equal to the value of NoP, the algorithm continues with the S1 and S2 sums calculation. 2N consecutive half periods duration values are added to each sum (positive and negative half periods). Sum S1 starts summing from half period duration value recorded in member m[P1] in array memory "m." Sometimes the first measured half period duration value stored in m[0] array member is not correct and the first half period duration value of sum S1 will not be considered as the first recorded half period duration value of memory m[0]. The first half period duration value of the second sum S2 is shifted to the P2 addend (or the member) from the first half period duration value of the first sum S1. The constant P2 is always greater than zero. After forming the sum S1 and S2, the algorithm checks if the difference between S1 and S2 is less then 1/64 of the S1 sum. If it is, the sum S1 or S2 represents the "N" signal period duration. If the calculated difference is not less than 1/64 of the sum S1, then the signal period duration is not detected. The part of the sum or some other small value taken as a limit, which must be less than the difference of the sum of S1 and S2, may be used as a decision criteria for calculating the signal period duration, and can depend on the input signal waveform and sometimes must be experimentally determined. The number of addends or members "NoP" in the array "m[ ]" must be greater than the sum P1+P2+2N to ensure a correct sum calculation. If during the half period duration measuring, the half period stop criteria is not achieved, the positive trigger value can be set to the minimum positive trigger value, the negative trigger value can be set to the maximum negative trigger value (setting the negative and the positive trigger value is not mandatory), the maximum signal variable "max" and the minimum signal variable "min" are set to the DC input signal component value, and the positive half period duration measuring starts again.

Figure 3:
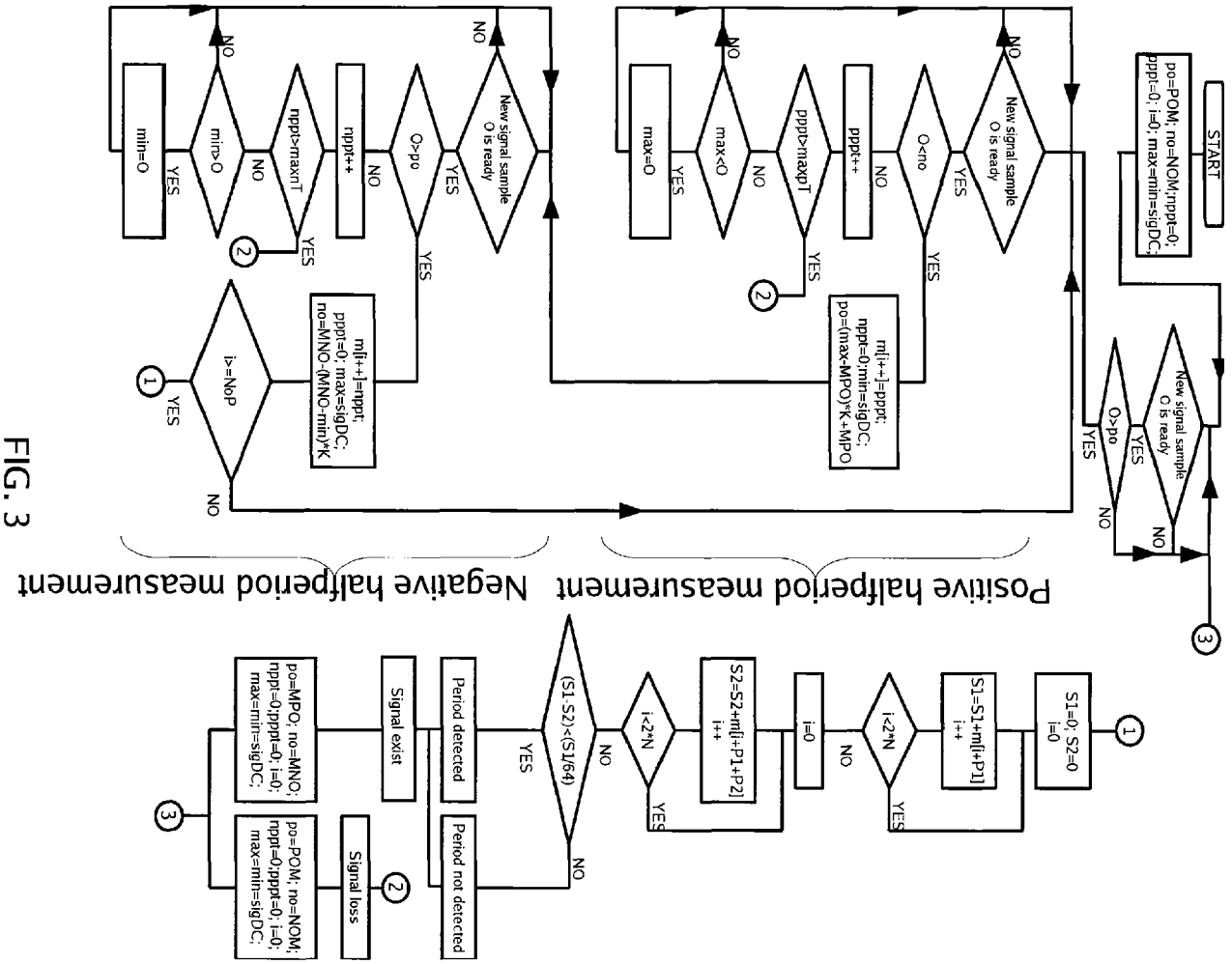
FIG. 3 shows a flow chart of the method described in this document where positive and negative trigger variable are calculated at a point in time where the input signal becomes greater then positive trigger or becomes less then negative trigger.

FIG. 3 shows an algorithm with the trigger value calculation at a point in time where the input signal becomes greater than the positive trigger value or less then negative trigger value.

The algorithm will be explained in connection with the microcontroller memory devices of FIG. 4, FIG. 5, FIG. 6, FIG. 7, FIG. 8, FIG. 9, FIG. 10, FIG. 11, FIG. 12, FIG. 13, FIG. 14, FIG. 15. Each of the FIGS. 4-15 shows an input analog low pass filter (triangle with "F" label), an Amplifier with constant gain A (triangle with "A" label), and a virtual microcontroller. The virtual microcontroller contains an AD converter (triangle with "AD" label), an 8-bit AD conversion register labeled as "O," and a plurality of 8 bit registers marked to correspond with the variables in the algorithm. The amplifier and filter are adjusted so that the amplifier output voltage level is one half of the AD converter input voltage range when no input signal is present at the filter input. Also the filter will pass only time variable signal components to the amplifier. As a result, one AD converter is needed for input of AC input signal components, which oscillate around one half of the AD converter input voltage range. Also, the algorithm assumes that the "t" coordinate for all of the curves shown in FIGS. 1*a*-1*d* overlap one half of the AD converter voltage range. Before the algorithm starts, the register "sigDC" contains a binary number corresponding to the AD conversion of the DC input signal value. The algorithm assumes that the microcontroller is sampled and converted to a binary number input corresponding to a DC level that is one half of the AD input range, when no signal is present at the filter input. As stated above, the binary number input is stored to register "sigDC." The measured positive half period duration is a 16 bit variable "pppt" and in the virtual microcontroller, the variable "pppt:h" is the high 8 bits, and the variable "pppt:l" is the low 8 bits. The measure negative half period duration is a 16 bit variable "nppt" and in the virtual microcontroller, the variable "nppt:h" is the high 8 bits, and the variable "nppt:l" is the low 8 bits.

Figure 4:
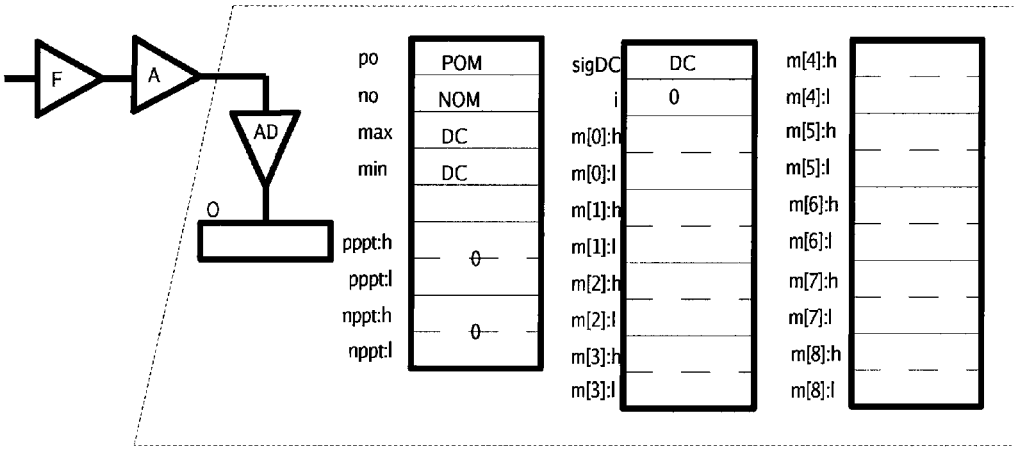
FIGS. 4 to 15 shows changes over time of a microcontroller's registers.

After initial register setup as shown in FIG. 4, the algorithm waits until the input signal becomes greater than variable "po," which is set to the value "POM." The input signal on FIG. 1*a* becomes greater than the value "POM" after "t0'". A new condition of the microcontroller is shown in FIG. 5 in that the AD converter register "O" is set with value S(t0') for an input signal sample value.

Figure 5:
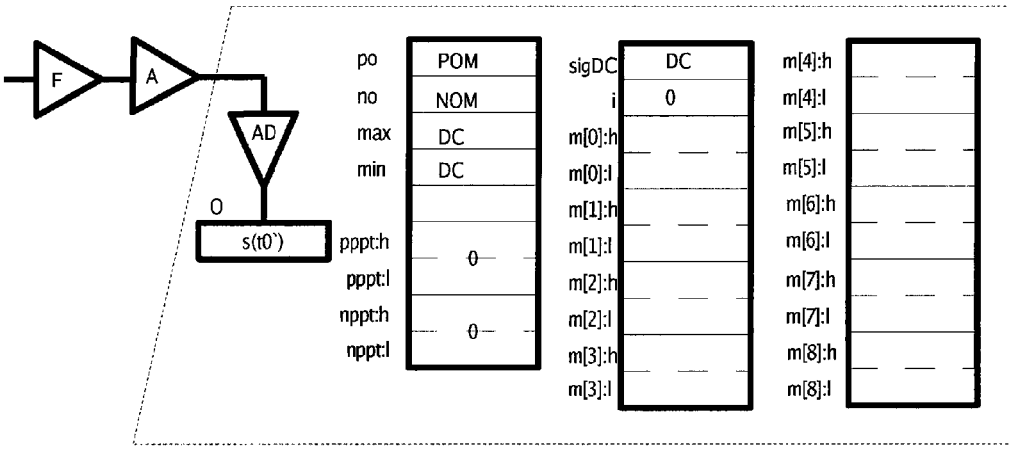
Figure 6:
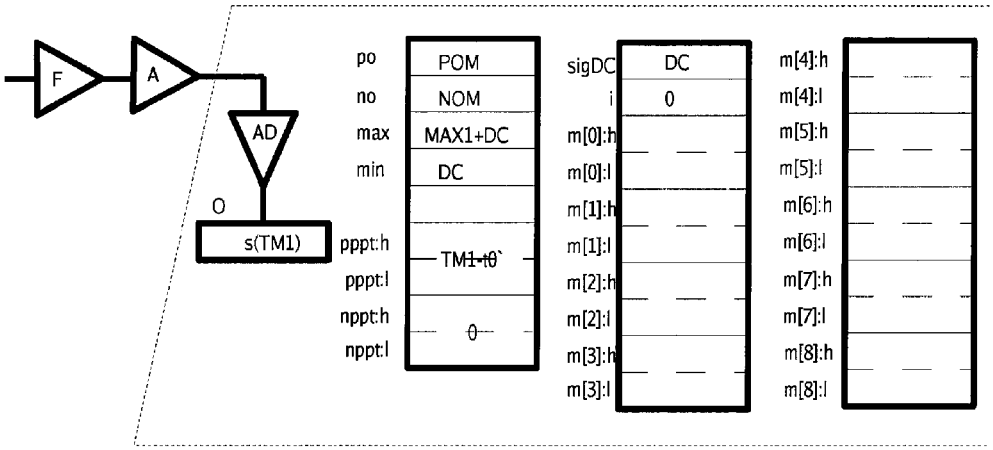
Figure 7:
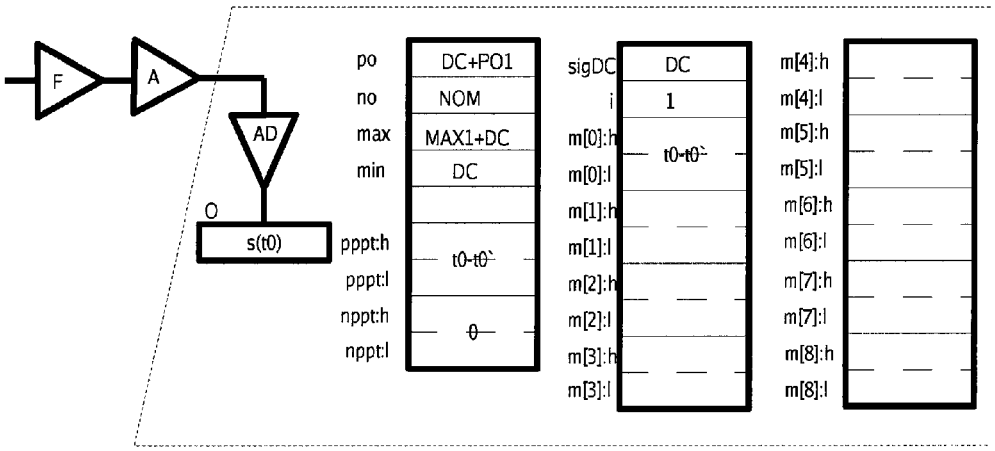

The positive half period duration measuring portion of the algorithm on the virtual microcontroller is illustrated in FIG. 5, FIG. 6, FIG. 7. FIG. 5 shows the microcontroller registers when the positive trigger value "po" just passes sample time "t0'". The maximum calculation starts and the positive half period duration measuring starts. As described above, the maximum register "max" will be set to new sample value if the new sample value is greater than the last sample value in register "max." On FIG. 1, from sample time "t0'" to sample time TM1, the value in the register "max" in the microcontroller changes until the maximum signal at sample time TM1 is reached in first signal period. After the TM1 sample, the value in register "max" in the microcontroller is not changed and the value in register "max" is set to MAX1+DC value (the "t" coordinate is DC signal level).

The microcontroller registers at the TM1 sample time are shown on FIG. 6. Sample TM1 is shown in register "O", and value MAX1+DC is shown in register "max", which is TM1 sample value. As shown on FIG. 1, after the TM1 sample, the value in microcontroller register "max" is not changed and has a value corresponding to MAX1+DC because all of the next signal samples up to sample time t1 are less then the value of MAX1+DC. The next characteristic point in the algorithm is taken at sample time t0 when input signal value becomes less then the negative trigger value stored in the register "no." At sample time t0, the input signal sample is less then value in the register "no." FIG. 7 also shows a new positive trigger value, which is calculated and stored in register "po" as a value corresponding to DC+PO1 (po=(max−MPO)*k+MPO, k=½). This new positive trigger will be used at sample time t1. This new state in the microcontroller registers is shown in FIG. 7. Also the 16 bit register "pppt" has a value corresponding t0−t0' that corresponds to the number of samples between sample t0' and t0. Thus, in register "pppt", the positive half period duration in sample numbers is stored. This positive half period duration is stored to the 16 bit register m[0] and pointer I is incremented to point to the next free register to store the next negative half period duration. In the 16 bit register m[0], m[0]:h corresponds to the high 8 bits and m[0]:l corresponds to the low 8 bits.

Figure 8:
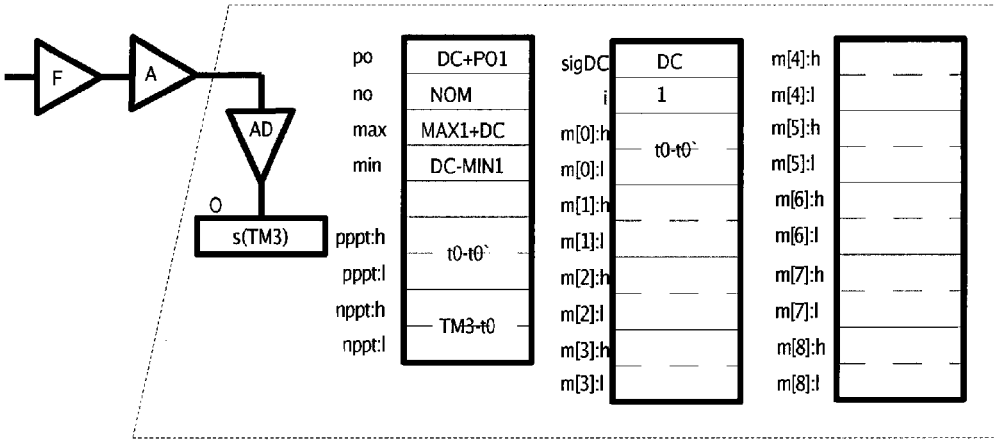
Figure 9:
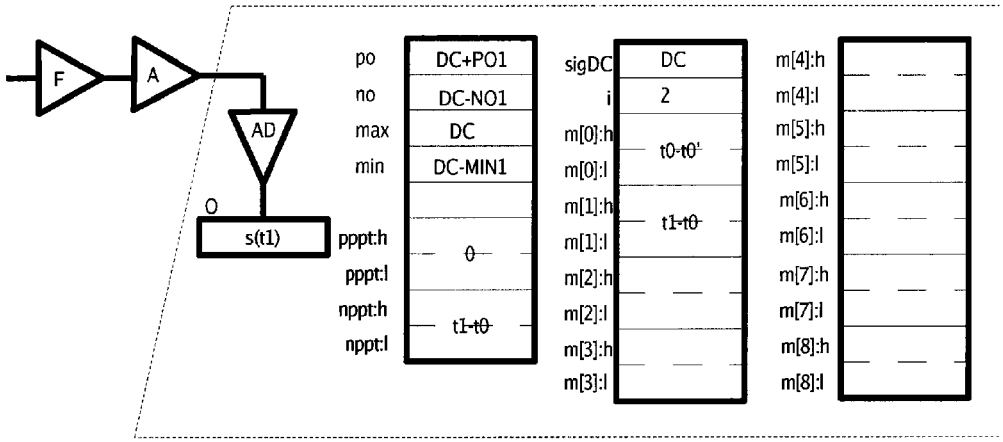

The algorithm for measuring the negative half period on the virtual microcontroller is illustrated in FIG. 7, FIG. 8, FIG. 9. FIG. 7 shows microcontroller registers when negative trigger value "no" is passed at sample time t0. At that time, the minimum calculations starts and the negative half period duration measuring starts. As will be described below, the minimum register "min" will be set to new sample value if new sample value is less than the last sample value stored in register "min". On FIG. 1, from sample t0 to sample TM3, the register "min" in the microcontroller also changes, and at the TM3 sample, the minimum signal is reached in first signal period. After the TM3 sample, the register "min" is not changed and the value in register "min" corresponds to DC−MIN1. The t coordinate overlaps the DC signal level. The TM3 sample microcontroller registers are shown in FIG. 8. In register O, the TM3 sample is stored and in MIN register, the value DC−MIN1 is stored, which corresponds to the TM3 sample value. As shown on FIG. 1, the curve "Minimum calculation", after the TM3 sample, the value stored in register "min" is not changed and has a value corresponding to DC−MIN1 because all of the next signal samples to sample time t2 are greater then DC−MIN1. The next characteristic point in the algorithm is at sample time t1, when the input signal value becomes greater then positive trigger value "po." At sample time t1, the input signal sample is greater than the value stored in register "po." Register "po" contains the positive trigger variable calculated at point t0. A new negative trigger value is calculated and stored in register "no" as value DC−NO1, (no=MNO−(MNO−min)*K, K=½). This new negative trigger will be used at sample time t2. This new state in the microcontroller registers is shown in FIG. 9. Also the 16 bit register "nppt" contains a value corresponding to t1−t0. The value t1−t0 is number of samples between sample times t0 and t1. So in the register "nppt", the negative half period duration is stored in sample numbers. This negative half period duration is stored to 16 bit registers m[1] and pointer I is incremented to point to next free registers to store the next positive half period duration.

After the first signal period, the positive and negative trigger values are proportional to the maximum and minimum signal level. The next calculation steps use the positive and negative trigger values that are proportional to maximum and minimum signal values, thereby providing precise period measurement.

Figure 10:
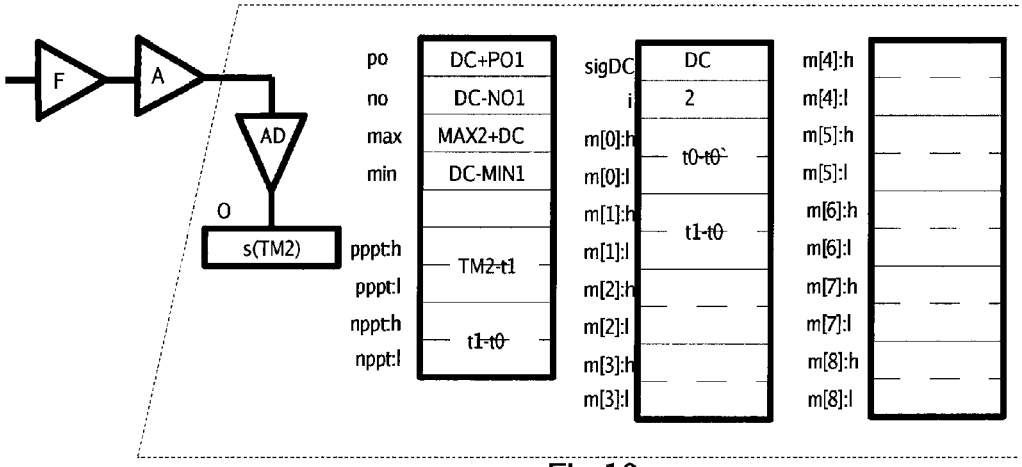
Figure 11:
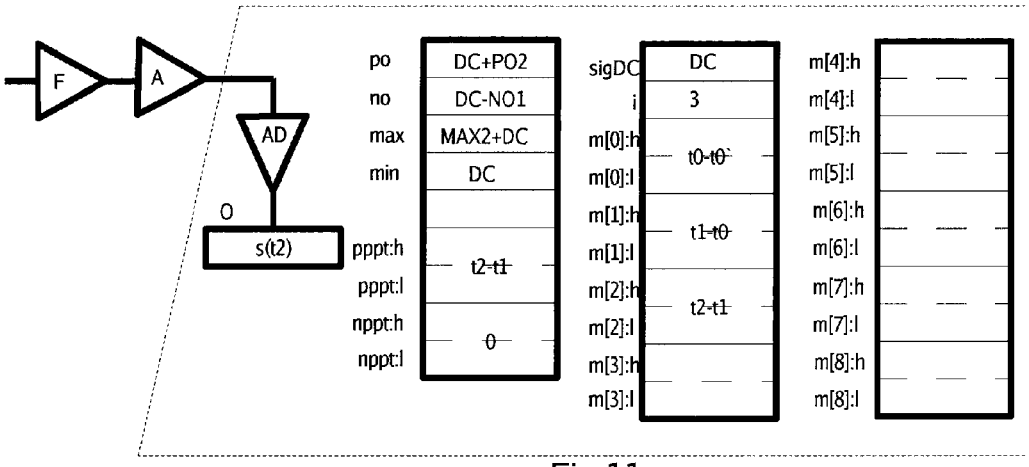

The positive half period measurement on the microcontroller after sample time t1 is illustrated on FIG. 9, FIG. 10, and FIG. 11. FIG. 9 shows the microcontroller registers when the positive trigger value po is passed at sample time t1. Thus, the positive trigger value is proportional to the signal maximum in the previous signal period. At sample time t1, the maximum calculation starts and the positive half period duration measuring starts. As will be described below, the maximum register "max" will be set to a new sample value if the new sample value is greater than the last sample value stored in the register "max". From sample t1 to sample TM2, the value stored in register "max" changes. The TM2 maximum signal is reached in second signal period. After the TM2 sample, the register "max" is not changed and the value stored in register "max" corresponds to MAX2+DC where the t coordinate is the DC signal level. The registers at the TM2 sample time are shown on FIG. 10. In register O, sample TM2 is stored, and in register "max", value MAX2+DC value is stored. After the TM2 sample, the microcontroller register "max" is not changed and has a value corresponding to DC+MAX2 because all of the next signal samples to sample time t3 are less than the value DC+MAX2. The next characteristic point in the algorithm is at sample time t2 when the signal value becomes less than the negative trigger value no. At sample time t2, the input signal value sample is less than the value in register "no", which corresponds to the negative trigger variable. The new positive trigger value is calculated and stored in register "po" as PO2+DC. This new positive trigger value will be used in sample time t3.

This new state in the microcontroller registers is shown in FIG. 11. The register "pppt" contains a value t2−t1. The "t" coordinate shows the sample number. Thus, t2−t1 is number of samples between sample time t1 and t2. In register "pppt", the positive half period duration in sample numbers is stored. This positive half period duration is stored to 16 bit registers m[2] and pointer I is incremented to point to the next free register to store the next negative half period duration. Also, 16 bit register "nppt" is set to 0 to prepare the algorithm for the next negative half period duration measurement.

Figure 12:
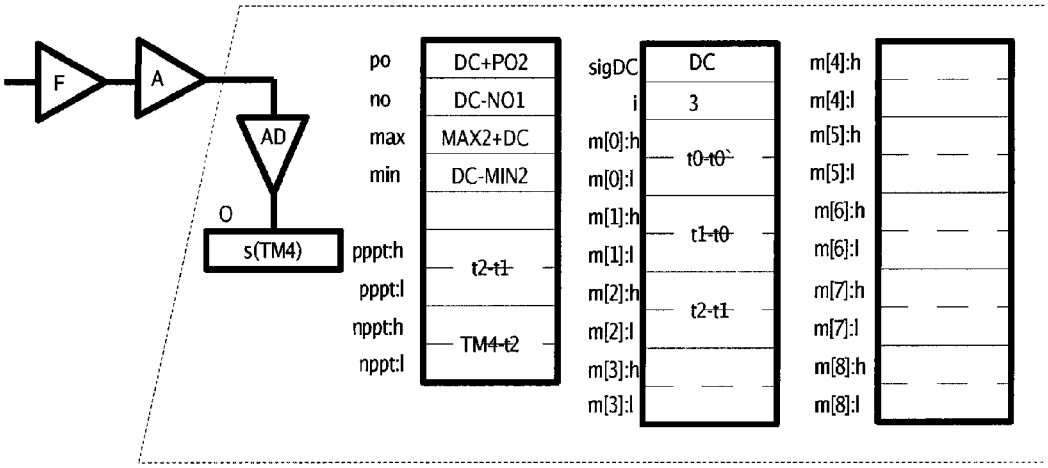
Figure 13:
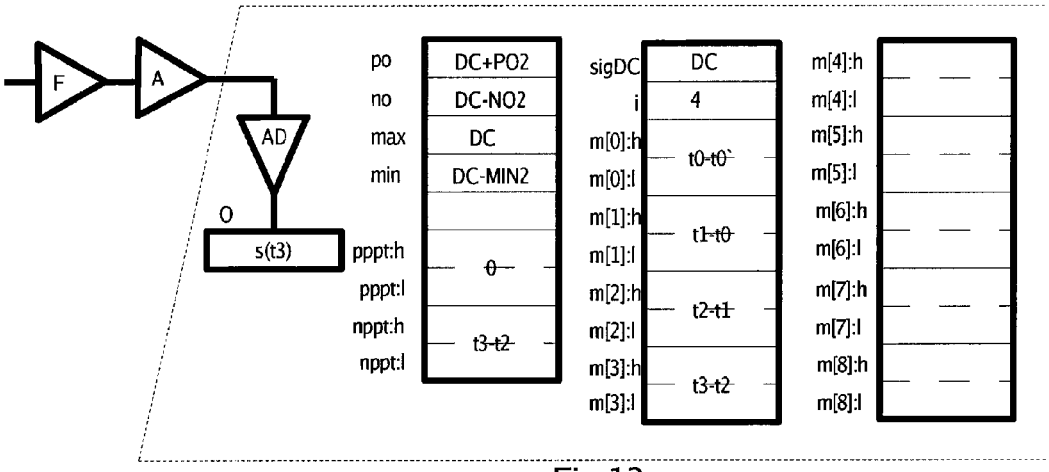

FIG. 11 shows the microcontroller registers when the negative trigger value no is passed in sample t2. At this time, the minimum calculation starts and the negative half period duration measuring starts. As will be described below, the minimum register "min" will be set to a new sample value if the new sample value is less than the last sample value in register "min". Referring to FIG. 1, from the sample t2 to sample TM4, the value stored in register "min" changes and the TM4 sample minimum signal is reached in second signal period. After the TM4 sample, the register "min" in microcontroller is not changed and contains the value corresponding to DC−MIN2 value, where the t coordinate is DC signal level. FIG. 12 shows the state of the registers at the TM4 sample time. In register "O", the sample TM4 is stored and in register "min", the value DC−MIN2 is stored, which corresponds to the TM4 sample value. After the TM4 sample, the microcontroller register "min" is not changed and contains value DC−MIN2 because all of the next signal samples to sample time t4 are greater than the value DC−MIN2. The next characteristic point in the algorithm is at sample time t3 when the input signal value becomes greater than the positive trigger po. At sample time t3, the input signal value sample is greater than the value in register "po". A new negative trigger value is calculated, and in register "no", the value DC−NO2 is stored. This new negative trigger value will be used at sample time t4. This new state in microcontroller register is shown in FIG. 13. The 16 bit register "nppt" has a value corresponding to t3−t2. As before, the t coordinate shows the number of samples, and accordingly, t3−t2 is number of samples between sample t2 and t3. Register "nppt" contains the negative half period duration in sample numbers. This negative half period duration is stored in the 16 bit registers m[3] and pointer I is incremented to point to the next free registers to store the next positive half period duration.

Figure 14:
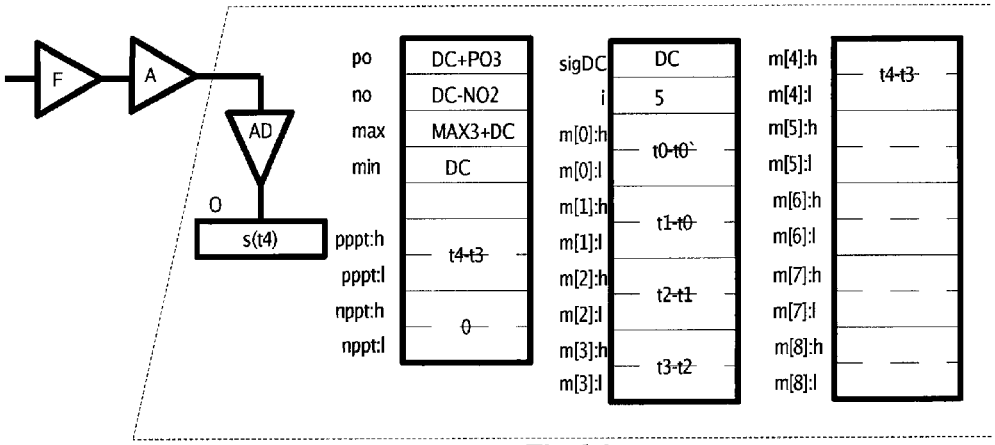
Figure 15:
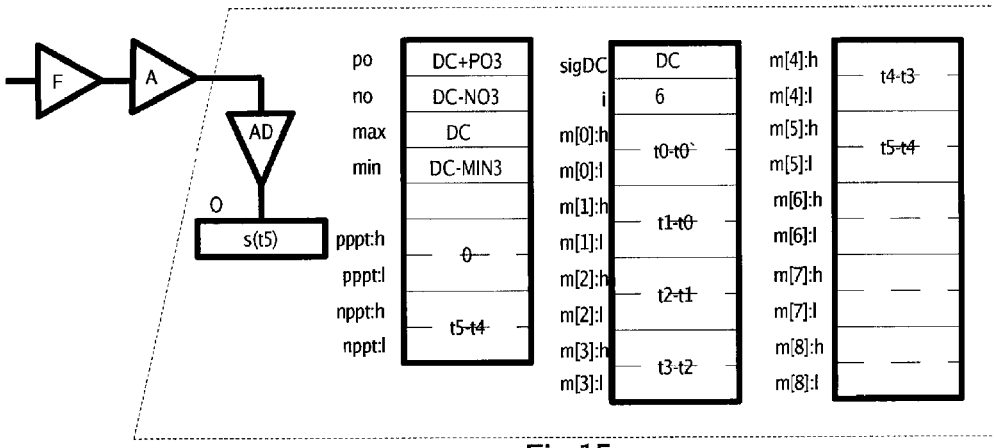

FIG. 14 shows microcontroller registers at the t4 sample time and FIG. 15 shows microcontroller registers at the t5 sample time.

As described above, the microcontroller registers m[ ] contains the measured half periods. After the first half period, the positive and negative trigger values are proportional to maximum and minimum in the first signal half period. At this point in the algorithm, two sums are calculated: sum S1=m[2]+m[3]=t3−t1 and sum S2=m[4]+m[3]=t4−t2. Sum S2 may also be calculated as S2=m[5]+m[4]=t5−t3. If the difference S2−S1 is small enough, then one of sums can be chosen as the signal period. This can be shown by the equation ((S1−S2)<(S1/64)).

This algorithm also detects signal loss when the positive or negative half period duration becomes greater than the constants maxpT or maxnT. When the algorithm is started, po=POM and no=NOM. After the sum S1 and sum S2 calculation, po=MPO and no=MNO. POM is greater than MPO and NOM is less than MNO. As described below, the algorithm determines when the input signal amplitude becomes low. When the input signal amplitude is under MPO or above MNO, signal loss will be detected, and po=POM and no=NOM. Signal amplitude will have to rise above POM and under NOM to start half period measuring again as described previously. Signal loss detection is used to generate commands corresponding to MIDI "note off," and signal detection and period detection is used to generate commands corresponding to MIDI "note on." When the input signal amplitude is not monotonously falling in time but increases and decrease in time, input signals will be detected when the positive amplitude is greater than POM, and signal loss will be detected when the positive amplitude is less than MPO. The difference between POM and MPO prevents the generation of false "note on" and "note off" commands, if the input signal amplitude variation is less than the difference of POM-MPO. Also, an input signal will be detected when the negative amplitude is under NOM, and signal loss will be detected when the negative amplitude is above MNO. The difference MNO-NOM will prevent the generation of false "note on" and "note off" commands, if the signal amplitude variation is less than the difference of MNO-NOM.

The methods described herein may be used to create MIDI control signals for operation of an electronic instrument by a simple musical instrument. Any sound source can be used to generate the MIDI control signals for an electronic music instrument. For instance, the methods described herein may be used to convert guitar string sounds to MIDI commands. The MIDI commands may be sent to an electronic device with an MIDI interface to produce sounds and different sound effects. The methods may also be employed for other string instruments, and for traditional instruments such as a trumpet, saxophone, etc.

The invention claimed is:

1. A method for creating a MIDI control signal for operation of an electronic instrument comprising:

initializing a positive trigger value to an initial positive trigger value that is greater than a DC component of an input signal and initializing a negative trigger value to an initial negative trigger value that is less than the DC component of the input signal;

measuring signal period by changing values of the positive and negative trigger values according to calculations based upon maximum and minimum values of the input signal;

calculating signal period duration based upon the negative and positive half period duration measurements of the input signal; and creating the MIDI control signal responsive to the calculated signal period duration.

2. The method of claim 1 further comprising:

sending the created MIDI control signal to an electronic device with an MIDI interface to produce sounds.

3. A device for creating a MIDI control signal for operation of an electronic instrument comprising:

a microcontroller for initializing a positive trigger value to an initial positive trigger value that is greater than a DC component of an input signal and initializing a negative trigger value to an initial negative trigger value that is less than the DC component of the input signal;

a microcontroller for measuring signal period by changing values of the positive and negative trigger values according to calculations based upon maximum and minimum values of the input signal;

a microcontroller for calculating signal period duration based upon the negative and positive half period duration measurements of the input signal; and a MIDI control signal generator for creating the MIDI control signal responsive to the calculated signal period duration.

4. The device of claim 3 further comprising means for sending the created MIDI control signal to an electronic device with an MIDI interface to produce sounds.

* * * * *